US007179100B2

(12) United States Patent
Montena

(10) Patent No.: US 7,179,100 B2
(45) Date of Patent: Feb. 20, 2007

(54) SECURITY SHIELD INTEGRAL WITH TAP FACEPLATE

(75) Inventor: Noah Montena, Syracuse, NY (US)

(73) Assignee: John Mezzalingua Associates Inc., East Syracuse, NY (US)

( * ) Notice: Subject to any disclaimer, the term of this patent is extended or adjusted under 35 U.S.C. 154(b) by 0 days.

(21) Appl. No.: 11/123,762

(22) Filed: May 6, 2005

(65) Prior Publication Data

US 2006/0252306 A1 Nov. 9, 2006

(51) Int. Cl.
*H01R 13/44* (2006.01)

(52) U.S. Cl. ..... 439/133

(58) Field of Classification Search ..... 439/133, 439/578, 675, 271, 277, 551
See application file for complete search history.

(56) References Cited

U.S. PATENT DOCUMENTS 3,603,912 A * 9/1971 Kelly ..... 439/273
4,469,386 A * 9/1984 Ackerman ..... 439/133
4,822,293 A * 4/1989 Robson ..... 439/271
4,998,894 A * 3/1991 Gronvall ..... 439/521
5,297,972 A * 3/1994 McMills et al. ..... 439/133
5,564,938 A * 10/1996 Shenkal et al. ..... 439/301
6,322,087 B1 * 11/2001 Swensen et al. ..... 277/626

* cited by examiner

*Primary Examiner*—Tulsidas C. Patel
*Assistant Examiner*—Phuongchi Nguyen
(74) *Attorney, Agent, or Firm*—Hiscock & Barclay, LLP; Alpa V. Patel

(57) ABSTRACT

The present invention provides a security shield integral with a CATV tap faceplate. The device comprises a substantially cylindrical housing, extending outward from the faceplate. The security shield is configured to receive an F-type connector. To safeguard against foreign elements, the shield is configured to receive a weather seal about the port. Additionally, a flap seal is provided, adding an additional seal between the outer wall of the F-Type connector and the inner wall of the security shield.

7 Claims, 3 Drawing Sheets

SECURITY SHIELD INTEGRAL WITH TAP FACEPLATE

TECHNICAL FIELD

The present invention relates to a tap assembly, such as for a CATV system, and in particular to a tap assembly having an integral security shield.

BACKGROUND OF THE INVENTION

Conventional cable broadcasting systems, such as cable antenna television (hereinafter CATV) systems wherein broadcasting signals are transmitted to a subscriber's terminal device via a drop cable provided from a tap device are known. Generally, tap devices include an incoming port for receiving the RF signal and multiple outgoing ports for providing signals to a plurality of locations. The number of outgoing ports on a tap is generally based upon the number of cable subscribers in the area. For instance, an eight-port tap can be placed geographically near eight homes, even if not all of the homes currently receive cable signals.

Because tap assemblies are commonly located outdoors, they are susceptible to the negative effects of elements, predominantly at the points wherein the drop cables are attached to the tap assembly. Furthermore, because tap assemblies are frequently situated in locations that are not secure, they are often targets for individuals seeking to tamper with cable television service.

U.S. Pat. No. 5,816,853 to Buekers, et al. discloses a cable connector housing for sealing the connection between a coaxial cable and a connector. The device comprises a pair of elongated body portions that surround the cable and connector. Additionally, the device is configured for containing a gel that seals the area surrounding the connection.

Furthermore, U.S. Pat. No. 4,998,894 to Gronvall discloses a housing for sealing a connector from adverse environments, wherein the housing has compartments configured to accept the tap port and connector combination. The compartments retain the housing on the tap, while providing a compartment for the connector when not connected to the tap.

While these devices may serve to protect the port from some of the harsh effects of the environment and tampering, they must be added to a tap and are not an integral part of the tap. It has became feasible and common for system operators to specify the use of weather sealing and tamper resistant accessories on connections, however they are not always installed correctly, leading to service issues such as physically degraded connections, and in other instances provide a less secure system from which service can be stolen. It would be an improvement if some or all of these features were built into the system equipment.

What is needed in the art is an apparatus and method for protecting a port of a tap assembly that is not difficult to install.

Furthermore, what is needed in the art is an apparatus and method for securing a connector to a port of a tap assembly wherein the port is protected from ill effects of the elements and is substantially tamper proof.

Furthermore still, what is needed in the art is an apparatus and method for securing a cable to a port on a tap assembly that permits the use of standard connectors and accessory seals to seal the port.

SUMMARY OF THE INVENTION

The present invention provides a security shield integral with a CATV tap faceplate. The device comprises a substantially cylindrical security shield, integral with and extending outward from the tap faceplate. The integral security shield permits the use of standard connectors and accessory seals. The security shield is configured to receive a standard F-type connector. To safeguard against foreign elements, the security shield is also configured to receive a weather seal about the port. Also, a flap seal is provided, to thereby add an additional means of protecting and insulating the connector.

An embodiment of the present invention comprises a tap faceplate having a substantially cylindrical security shield extending outward therefrom. This embodiment comprises a weather seal for providing a sealing means about the connector port, and the flap seal positioned between the connector and the inner surface of the cylindrical security shield for providing an additional sealing means.

Another embodiment of the present invention comprises an improved F-type connector having an integral weather seal attached thereto. The improved F-type connector is positioned within the security shield, thereby providing a sealing means about the connector port. Additionally, a flap seal is positioned between the outer surface of the connector and the inner wall of the cylindrical shield, thereby providing an additional sealing means for the port.

An additional embodiment is disclosed wherein a standard F-type connector is provided within the cylindrical shield and a flap seal is positioned between the connector and the cylindrical shield, thereby providing a sealing means for the port.

Furthermore, the present invention comprises a method of protecting, and providing a seal for a connection port of a CATV tap faceplate. The method comprises the steps of: inserting a weather seal into a security shield extending outward from a tap faceplate, inserting a connector into the security shield, and advancing a threaded component of said connector onto said threaded port component, thereby compressing the weather seal into abutting engagement with an inner surface of the cylindrical housing and said tap faceplate.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
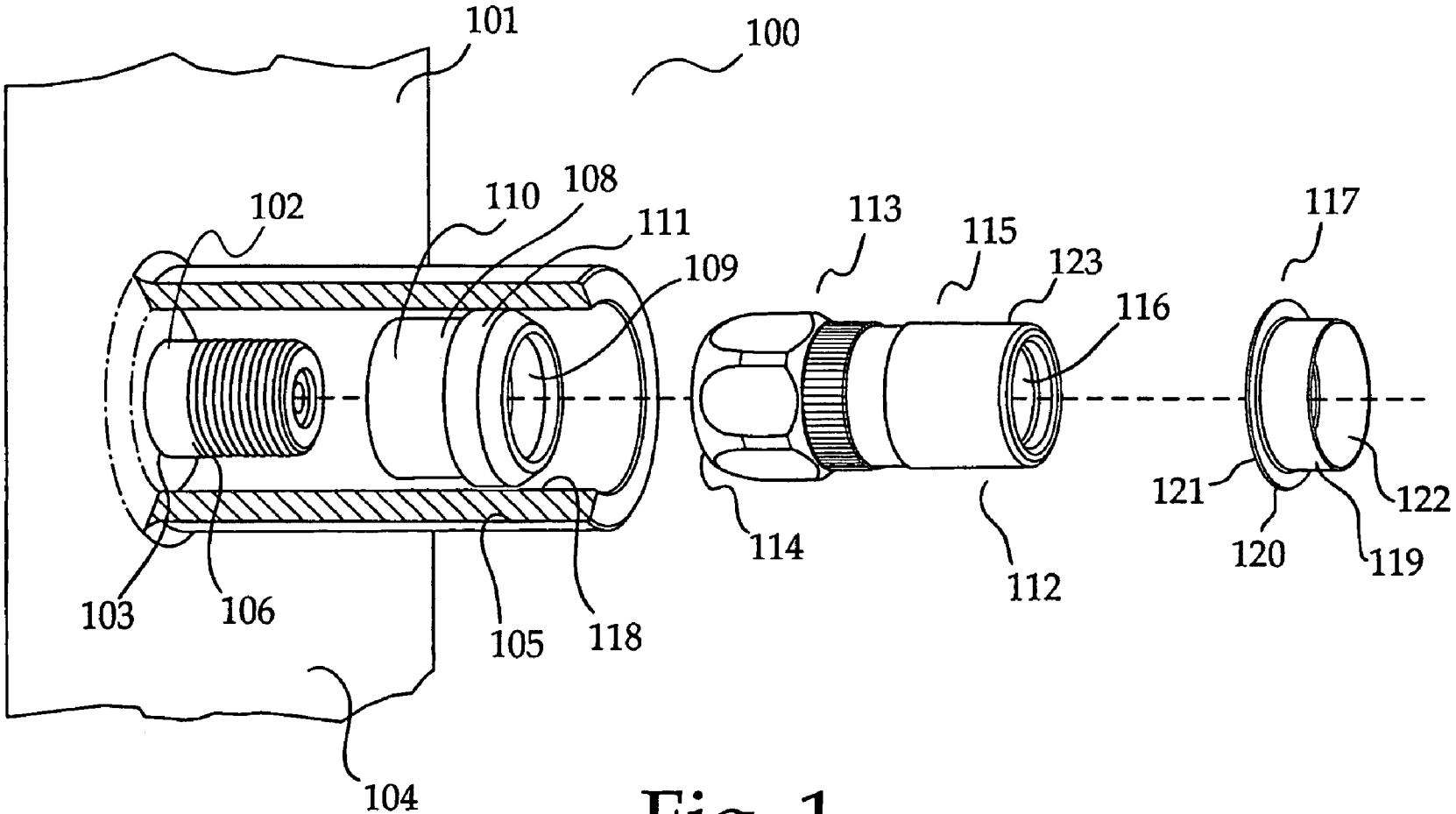
FIG. 1. is a perspective view illustrating elements of a first embodiment of the CATV tap assembly of the present invention.

Referring to FIG. 1, a perspective view illustrating elements of the present invention is shown. The present invention comprises a tap assembly having at least one port. The tap assembly has a tap faceplate with an inner surface and an outer surface having at least one partially threaded bore 103 there between. The partially threaded bore 103 is adapted to receive a threaded portion of port 102. The port 102 is a substantially cylindrical object having a first threaded end 106, wherein each of said first threaded end 106 is adapted to receive an RF connection device, such as for example, an F-Type connector.

Referring again to the tap faceplate 101, the outer surface 104 further comprises a substantially cylindrical shield 105 integral with, and extending outward therefrom. Furthermore, the aforementioned port 102 is enclosed within the cylindrical shield 105, wherein the cylindrical shield 105 and port 102 are in axial alignment.

The device of the present invention further comprises a weather seal 108. The weather seal 108 is a substantially cylindrical object having a flanged end 111. The weather seal 108 further comprises a substantially annular bore 109 throughout its axial length. The annular bore 109 is adapted to receive about the aforementioned port 102. Furthermore, the weather seal 108 is adapted to be received within the aforementioned cylindrical shield 105. The weather seal 108 is produced of a suitable elastomeric material which is deformable under sufficient applied pressure.

The F-type connector 112 has a bore 116 throughout its axial length. A first end of the F-type connector 112 comprises an external gripping means 113, and an internal threaded segment 114. The gripping means 113 is accessible via a security wrench, thereby serving to advance the threaded component 114 of the F-type connector upon the threaded segment 106 of the port 102.

Additionally, a flap seal 117 is provided, thereby adding an additional seal between the outer wall 115 of the F-Type connector 112 and the inner wall 118 of the cylindrical shield 105. The flap seal 117 also permits the usage of the security wrench. The flap seal 117 comprises a cylindrical segment 119, terminating at an annular lip 120. When affixed to the assembled device, the outer diameter 121 of the annular lip 120 is configured to communicate with the inner surface 118 of the cylindrical shield 105, and the inner surface 122 of the cylindrical segment 119 of the flap seal 117 is configured to communicate with the outer surface 123 of the connector 112, thereby providing an additional means of sealing the connector from the negative effects of the elements as well as tampering.

Figure 2:
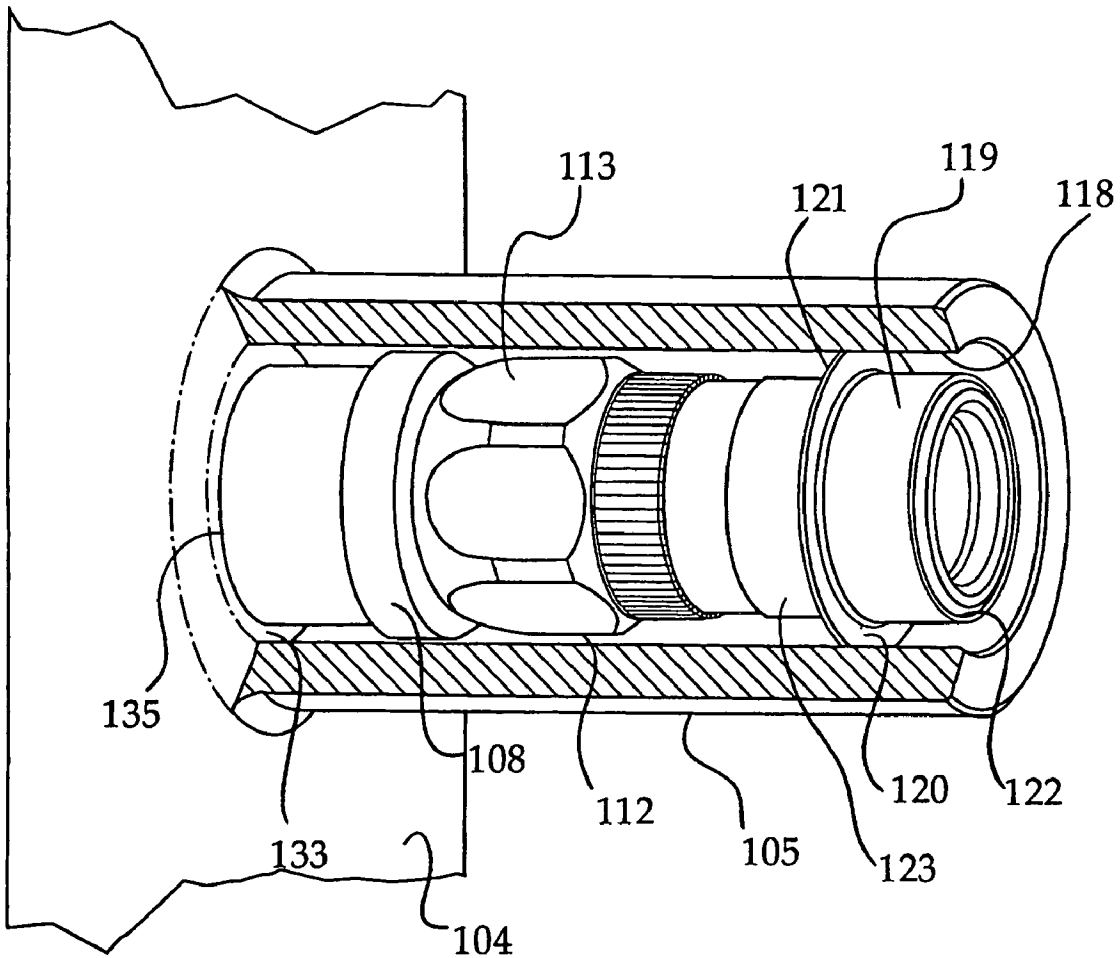
FIG. 2 is a perspective view of an assembled second embodiment according to the present invention with portions broken away.

Referring now to FIG. 2 an additional embodiment is shown wherein a weather seal 108 is integral with the connector 112. The connector 112 comprises a hexagonal gripping means 113, which serves to facilitate attaching and detaching the connector to the port contained within the cylindrical shield 105. The connector 112 further comprises an internal threaded segment (not shown) adapted to be threadedly attached to the external threads (not shown) of the port 102 (FIG. 1). The weather seal 108 is produced of a suitable elastomeric material which is deformable under sufficient applied pressure. Furthermore, the weather seal 108 comprises a lower surface or rim 135. In operation, advancing the connector 112 toward the tap faceplate 104 serves to compress the lower rim 135 of the weather seal 108 against the surface 133 of the tap face plate, thereby forming a sealing means about the port and protecting the connector.

Additionally, this particular embodiment comprises a flap seal 117 (FIG. 1) which provides an additional seal between the outer wall 115 (FIG. 1) of the F-Type connector 112 and the inner wall 118 of the cylindrical shield 105. This embodiment also permits usage of the security wrench. As in the previous embodiment, the flap seal 117 (FIG. 1) comprises a cylindrical segment 119, terminating at an annular lip 120. When affixed to the assembled device, the outer diameter 121 of the annular lip 120 is configured to communicate with the inner surface 118 of the cylindrical shield 105, and the inner surface 122 of the cylindrical segment 119 of the flap seal 117 (FIG. 1) is configured to communicate with the outer surface 123 (FIG. 1) of the connector 112, thereby providing an additional seal about the connector.

Figure 3:
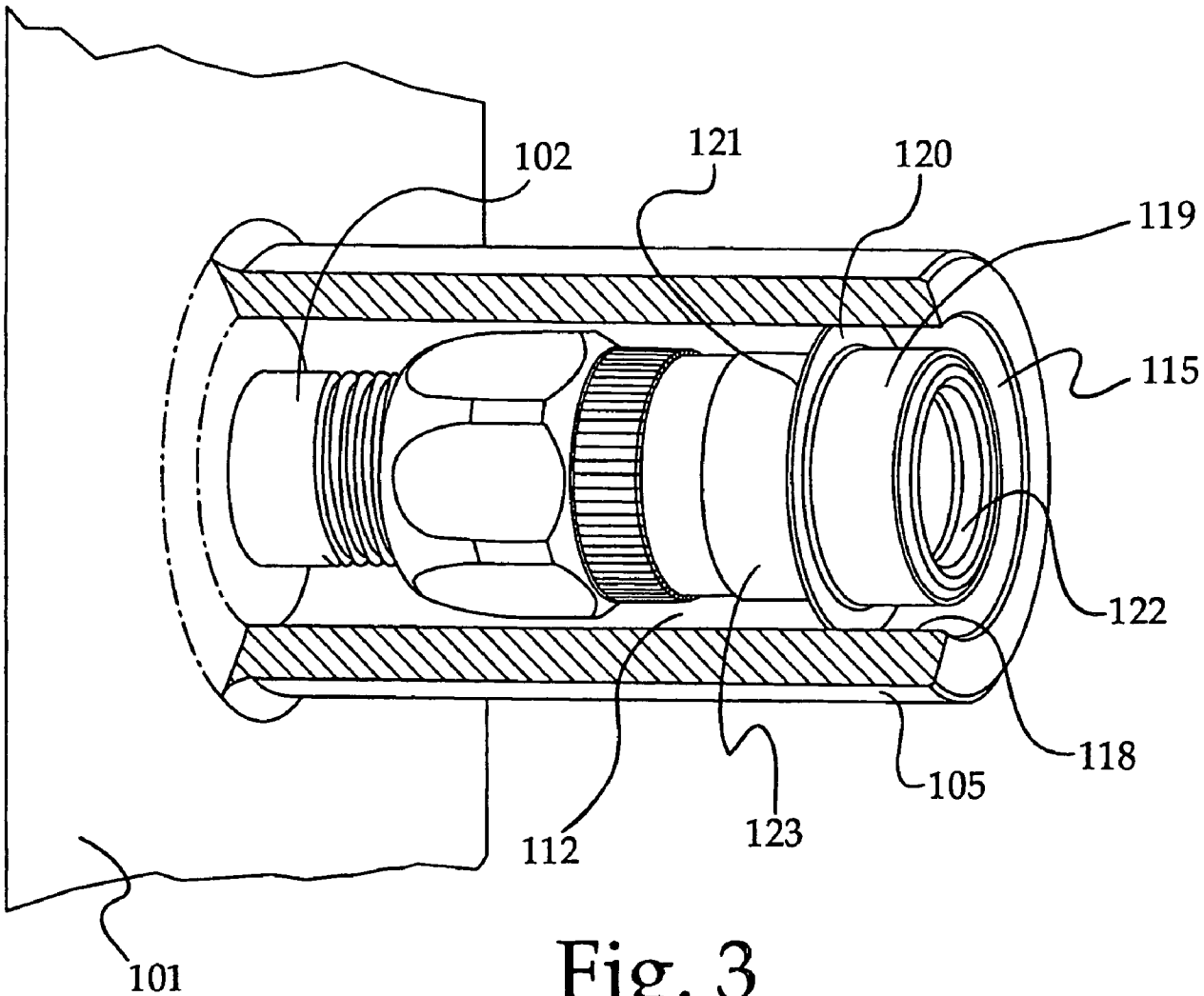
FIG. 3 is a perspective view of an assembled third embodiment according to the present invention with portions broken away.

Referring now to FIG. 3, an additional embodiment of the present invention is shown wherein only a flap seal 119 is attached to the connector 112 contained within the cylindrical shield 105. Once again, tap faceplate 101 is shown having integral cylindrical shield 105 extending outward therefrom. In this particular embodiment, a standard F-type connector 112 is used. Additionally, the weather seal, as disclosed in the previous two embodiments is not included. This particular embodiment comprises a flap seal 117 (FIG. 1). As in the previous disclosed embodiments, the flap seal comprises a cylindrical segment 119, terminating at an annular lip 120. When affixed to the assembled device, more particularly an F-type connector 112 contained within the cylindrical shield 105, the outer diameter 121 of the annular lip 120 is configured to communicate with the inner surface 118 of the cylindrical shield 105, and the inner surface 122 of the cylindrical segment 119 of the flap seal 117 (FIG. 1) is configured to communicate with the outer surface 123 of the connector 112. As installed, the flap seal 119 works in concert with the F-type connector 112 and cylindrical shield 105 to thereby provide a seal for protecting the connector and port from the negative effects of the elements, as well as tampering. As in the previous embodiments, a security wrench is required to access the connector, thereby permitting installation or removal.

While this invention has been described as having particular embodiments, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

I claim:

1. An improved CATV tap assembly comprising:

a) a faceplate;

b) at least one port having a threaded component for receiving and retaining a connector;

c) a security shield comprising a substantially cylindrical housing, integral with and extending outward from said faceplate, wherein said security shield surrounds and is coaxial with said threaded component of said at least one port; and d) a weather seal contained within said security shield for sealing said threaded component of said at least one port, wherein said weather seal surrounds said threaded component of said at least one port wherein said weather seal comprises an upper flanged end and a lower rim, said upper flanged end is adapted to communicate with said connector, and said lower rim is in abutting engagement with said faceplate upon installation.

2. An improved CATV tap assembly comprising:

a faceplate;

b) at least one port having a threaded component for receiving and retaining a connector;

c) a security shield comprising a substantially cylindrical housing, integral with and extending outward from said faceplate, wherein said security shield surrounds and is coaxial with said threaded component of said at least one port; and d) a weather seal integral with said connector for sealing said threaded component of said at least one port, wherein said connector comprises a gripping means, and said weather seal comprises a lower rim and an upper flanged end integral with said gripping means.

3. The improved CATV tap assembly of claim 2 wherein advancing said connector onto said threaded component serves to deform said weather seal such that an outer perimeter of said upper flanged end is in abutting engagement with an inner surface of said security shield, and said lower rim of said weather seal is in abutting engagement with said tap faceplate, thereby sealing said threaded component.

4. A method of providing a seal for a connection port of a CATV tap faceplate, comprising the steps of:

inserting a weather seal into a security shield extending outward from a tap faceplate, wherein said weather seal comprises a bore adapted to receive a threaded component of said port;

inserting a connector into said security shield;

advancing a threaded component of said connector onto said threaded port component, thereby compressing said weather seal into abutting engagement with an inner surface of said cylindrical housing, and said tap faceplate; and sealing said threaded component of said port.

5. The method of claim 4 further comprising the step of inserting a flap seal into the security shield, wherein said flap seal is in abutting engagement with the outer surface of said connector and the inner surface of said security shield.

6. A method of providing a seal for a connection port of a CATV tap faceplate, comprising the steps of:

inserting a connector having an integral weather seal into a security shield extending outward from a tap faceplate, wherein said weather seal comprises a bore adapted receive a threaded component of the port;

inserting a connector into said security shield;

advancing a threaded component of said connector onto said threaded component of said port, thereby compressing said integral weather seal into abutting engagement with an inner surface of said security shield and said tap faceplate; and sealing said threaded component of said port.

7. The method of claim 6 further comprising the step of inserting a flap seal into security shield, wherein said flap seal is in communication with the outer surface of said connector and the inner surface of said security shield.

* * * * *